US007955014B2

(12) United States Patent
Thorpe et al.

(10) Patent No.: US 7,955,014 B2
(45) Date of Patent: Jun. 7, 2011

(54) DISPENSER WITH MOVING ASSEMBLY WITH ENCASED VALVE

(75) Inventors: Timothy Thorpe, Santa Monica, CA (US); Luis Alviar, Santa Monica, CA (US)

(73) Assignee: HCT Asia Ltd, Hong Kong (CN)

( * ) Notice: Subject to any disclaimer, the term of this patent is extended or adjusted under 35 U.S.C. 154(b) by 217 days.

(21) Appl. No.: 12/270,340

(22) Filed: Nov. 13, 2008

(65) Prior Publication Data

US 2010/0119290 A1 May 13, 2010

(51) Int. Cl.
*B43K 7/12* (2006.01)

(52) U.S. Cl. ..... 401/115; 401/280; 401/274; 401/287; 401/282; 15/184

(58) Field of Classification Search ..... 401/280–283, 401/285, 286, 287, 115, 265, 266, 270, 274, 401/99, 123, 117; 15/184; 137/625.18, 625.19, 137/625.17
See application file for complete search history.

(56) References Cited

U.S. PATENT DOCUMENTS

| | | | | | |
|---|---|---|---|---|---|
| 1,065,879 | A * | 6/1913 | Krebs | 401/272 |
| 1,188,214 | A * | 6/1916 | Sohn | 222/242 |
| 1,355,026 | A * | 10/1920 | Austin | 401/117 |
| 1,358,597 | A * | 11/1920 | Tobias | 15/110 |
| 1,365,246 | A * | 1/1921 | Kendall | 222/542 |
| 1,626,992 | A * | 5/1927 | Willk | 401/117 |
| 1,659,800 | A * | 2/1928 | Bailey | 401/18 |
| 3,536,333 | A * | 10/1970 | Gits et al. | 277/372 |
| 4,224,958 | A * | 9/1980 | Kaplan et al. | 137/340 |
| 6,418,939 | B1 * | 7/2002 | Byun | 132/313 |

* cited by examiner

*Primary Examiner* — Gregory L Huson
*Assistant Examiner* — Keegan Gumbs
(74) *Attorney, Agent, or Firm* — Lee & Hayes, PLLC

(57) ABSTRACT

A dispenser includes a moving assembly which includes an upper valve and a lower valve having a reservoir for containing a product. The upper valve having at least one aperture is coupled to the lower valve having at least one aperture. Furthermore, the lower valve and the upper valve are partially covered by a sleeve. The sleeve includes a shaped path. The upper valve and the lower valve being selectively guidable along the shaped path between an upward position for the dispenser to deliver the product and a downward position to store the dispenser.

16 Claims, 11 Drawing Sheets

DISPENSER WITH MOVING ASSEMBLY WITH ENCASED VALVE

BACKGROUND

Devices exist for dispensing cosmetic, medicinal, food, household, or other type products. Such devices usually consist of an outer housing, a delivery mechanism for dispensing the different types of products, and an applicator. For example, in various industries, devices are employed for applying powder, gel, creams, or lotions. In the cosmetics and personal care industries, devices are used to apply lipstick, lip balm, skin creams, lotions, compact powder, loose powder, and other cosmetic products to portions of the face and body.

Typically, these devices have many drawbacks. For example, the product may not be dispensed at a controlled rate, allowing either too little or too much to come out of the device. Another problem is that an applicator on the device may allow product to continue to flow out of the device, once the desired amount of product has been dispensed. For example, the product may leak or spill out of the device, especially when travelling from one location to another for reapplication during the day, resulting in a wasted amount of product and a mess for the user. Another problem is the applicator does not remain extended in one position when the user may want to use the applicator (without applying more product). Accordingly, there remains a need in the art for improved devices.

SUMMARY

This summary is provided to introduce simplified concepts of moving assembly with encased valve in dispensers, which are further described below in the Detailed Description. This summary is not intended to identify essential features of the claimed subject matter, nor is it intended for use in determining the scope of the claimed subject matter.

This disclosure is directed to dispensers having an assembly with an encased valve that are selectively guidable along a shaped path between an upward position and a downward position. This disclosure describes a dispenser including an upper valve, a lower valve with a reservoir for containing a product, and a sleeve having the shaped path. The assembly of the upper valve and the lower valve being selectively guidable along the shaped path to the upward position for the dispenser to deliver the product and to the downward position to store the dispenser. Furthermore, the dispenser includes an applicator for applying the product.

This disclosure is directed to another implementation of a dispenser with an assembly with an encased valve. The assembly includes an upper valve, a flow-through gasket, a lower valve with a reservoir for containing a product, and a sleeve with the shaped path. The upper valve and the lower valve, each includes a guide pin. In alternate implementations, either the upper guide pin or the lower guide pin may selectively be guidable along the shaped path while the lower valve or the upper valve, respectively, is held stationary. The guide pin is selectively guidable along the shaped path causing the assembly to be selectively moveable between the upward position to deliver product or to hold the applicator in an extended state and the downward position to retract the applicator.

The features, functions, and advantages that have been discussed above or will be discussed below can be achieved independently in various implementations, or may be combined in yet other implementations, further details of which can be seen with reference to the following description and drawings.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

One implementation of this disclosure is directed towards cosmetic dispensers having an assembly with encased valve to selectively move the assembly along a shaped path. A cosmetic dispenser includes the assembly of a lower valve with a reservoir and an upper valve that are partially covered by a sleeve with the shaped path. In some implementations, the assembly may also include a flow-through gasket. The assembly with encased valve being selectively moveable between i) an upward position for the dispenser to deliver the cosmetic product and ii) a downward position to store the dispenser. The upward and downward positions travel along the shaped path. The shaped path may include a substantially L-shape configuration, a substantially Y-shape configuration, and a substantially forked-shape configuration.

By way of example and not limitation, the dispenser with the moving assembly with encased valve described herein may be applied in many contexts and environments. For example, the dispenser with the moving assembly with encased valve may be implemented for medicinal products, cosmetics and personal care industries, powdered or liquid cosmetic products, mineral products, food products, spices, carpet deodorizers, baking soda, and the like. For example, in various industries, the dispenser with the moving assembly with encased valve may be employed for applying powdered, gel, creams, or lotion products. In the cosmetics and personal care industries, the dispenser with the moving assembly with encased valve may be used to apply lipstick, lip balm, skin creams, lotions, powdered, loose powder, and other cosmetic products to portions of the face and body.

Illustrative Dispenser with the Moving Assembly with Encased Valve

Figure 1:
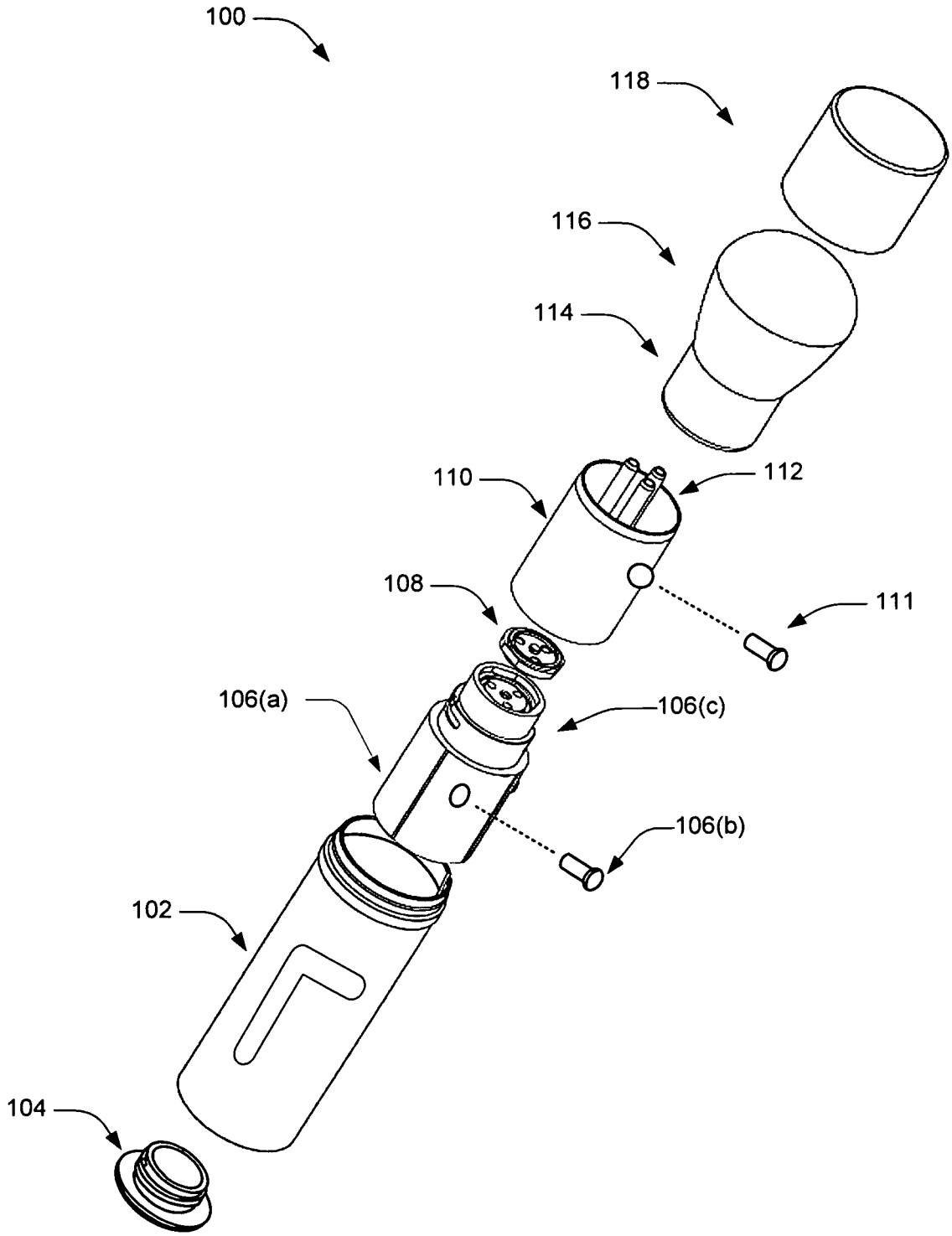
FIG. 1 is an exploded view of an illustrative dispenser with a moving assembly with encased valve according to one implementation.

FIG. 1 is an exploded view of an illustrative dispenser with a moving assembly with an encased valve 100 according to one implementation. FIG. 1 represents the illustrative dispenser with moving assembly 100 having a sleeve 102 that partially covers the various components of the dispenser 100. In some implementations, the shaped path may include an L-shape configuration, a Y-shape configuration, or a forked-shape configuration to help guide the dispenser movement. In some instances, the sleeve 102 may be made of clear, substantially opaque, or translucent materials.

The dispenser with the moving assembly with encased valve 100 includes an end cap 104 coupled to a lower valve 106(*a*) with a reservoir for containing product. In some implementations, the lower valve 106(*a*) may be constructed as a separate piece from the reservoir. While in other implementations, the lower valve may be constructed with an attached reservoir as one piece. The lower valve 106(*a*) dimensions include but are not limited to, height from at least about 20 mm to at most about 60 mm and diameter from at least 20 mm to at most 35 mm. The end cap or refillable cap 104 keeps the product in the reservoir.

The lower valve 106(*a*) may include a lower guide pin 106(*b*). The lower valve 106(*a*) may also include a lower valve seat 106(*c*) or a mouth of the lower valve to hold the flow-through gasket 108. The lower valve seat 106(*c*) includes at least one aperture and at least one or more ridges around the external circumference to form a recessed area.

The plurality of apertures in the flow-through gasket 108 is alignable with the plurality of apertures in the lower valve seat 106(*c*) for product delivery. In some implementations, the lower valve 106(*a*) may be constructed as a separate piece from the flow-through gasket. While in other implementations, the lower valve may be constructed with an attached flow-through gasket with each formed of different materials. A more detailed discussion of the flow-through gasket 108 follows in FIGS. 5*a*, 5*b*, and 5*c*.

The dispenser 100 also includes an upper valve 110, which includes an upper guide pin 111. The upper valve 110 is connected to the lower valve 106(*a*) by aligning the upper guide pin 111 on the upper valve 110 to the lower guide pin 106(*b*) on the lower valve 106(*a*). At this position of alignment of the two guide pins, the at least one aperture in the upper valve 110 is not aligned with the at least one aperture of the flow-through gasket 108 and the lower valve 106(*a*). Therefore, there is no passageway for product delivery and this position may be referred to as a closed state.

During rotation by the user, the upper guide pin 111 on the upper valve 110 may travel to the top and is guided into the upper top portion of the L-shaped configuration on the sleeve 102 to the upward position. When the upper guide pin 111 travels along the L-shaped configuration on the sleeve 102, the upper valve 110 is selectively rotatable toward this path. The motion into the L-shaped configuration misaligns or rotates the upper guide pin 111 away from the lower guide pin 106(*b*). However, this motion then selectively aligns the at least one aperture in the upper valve 110 to align with the at least one aperture in the flow-through gasket 108 and with the at least one aperture in the lower valve seat 106(*c*) (these two are already aligned). This alignment creates an open state for product delivery. In this upward raised position and opened state, the applicator is exposed or raised for use.

The upper valve 110 also includes an attachment seat 112 that is co-molded together as one piece or may be formed of two separate pieces. The attachment seat 112 may include a plurality of pipes as shown in the figure or alternatively, there may not be any pipes in the attachment seat 112. In another implementation, the flow-through gasket is disposed on the base of the upper valve.

As mentioned above, the assembly, which includes the lower valve 106(*a*), the flow-through gasket 108, and the upper valve 110, is capable of being selectively moveable in the upward position for product delivery. This open state allows at least one pipe or one aperture in the upper valve 110 being alignable with the at least one aperture in the flow-through gasket 108 and being alignable with the at least one aperture in the lower valve seat 106(*c*) to operate in the open state to deliver product. The assembly is also capable of being selectively moveable in the downward position, which allows the at least one raised section in the upper valve 110 being alignable with the at least one aperture in the flow-through gasket 108 and the at least one aperture in the lower valve to operate in the closed state. This closed state prevents leakage of the product by creating a seal.

In some implementations, the at least one aperture in the flow-through gasket may already be alignable with the at least one aperture in the upper valve. In these implementations, the at least one aperture in the flow-through gasket and the upper valve are selectively alignable with the at least one aperture in the lower valve for the open state.

In some implementations, there may not be a flow-through gasket. In implementations without the flow-through gasket, the at least one aperture in the upper valve selectively aligns with the at least one aperture in the lower valve for the open state. For the closed state, the at least raised section in the upper valve 110 selectively aligns with the at least on aperture in the lower valve. Again, this position creates a seal to prevent product leakage. In some implementations, the raised sections in the upper valve 110 align with the apertures in the flow-through gasket or with the apertures in the lower valve to the closed state for no product delivery. While in other implementations, the raised sections in the lower valve align with the apertures in the flow-through gasket or with the apertures in the upper valve for no product delivery.

This guidable mechanism may range from a rotation of at least about five degrees to at most about 180 degrees. In some implementations, the guidable mechanism may range from at least about 10 degrees to at most about 90 degrees. Furthermore, the flow-through gasket 108 allows a controlled rate of product to be dispensed at one time without product being distributed all over the user or creating a mess in a purse or a carrying type device.

The at least one aperture in the lower valve seat 106(*c*), the flow-through gasket 108, and the upper valve 110 may have shapes that include but are not limited to, substantially circular-shape, substantially square-shape, or substantially oval-shape. The number of apertures in the lower valve seat 106(*c*), the flow-through gasket 108, and the upper valve 110 may range from at least about one to at most about five apertures. The size of the apertures in the lower valve seat 106(*c*), the flow-through gasket 108, and the upper valve 110 is of a sufficient size and of an adequate opening to allow for product delivery without being plugged. For example, the size of the apertures may range from at least about 1 mm to at most about 6 mm. In one implementation, each aperture is at least about 2.5 mm in size. The configuration of the apertures may range from three apertures positioned at 120 degrees apart from each other. In another implementation, the configuration of the apertures may range from four apertures positioned at 90 degrees apart from each other. The shape, number, and size of the apertures in the lower valve seat 106(*c*), the flow-through gasket 108, and the upper valve 110 may be different in relation to each other.

The at least one pipe in the attachment seat 112 may range in length from at least about 9 mm to at most about 35 mm and may range in diameter from at least about 2 mm to at most about 4 mm. The number and the diameter size of the pipes and the number and diameter size of the raised sections on the upper valve 110 may be similar or not similar in the number and diameter size of apertures in the flow-through gasket 108 and the lower valve seat 106(*c*).

The lower valve 106(*a*) may be secured to the end cap 104 and to the upper valve 110, by, for example, a press-fit, a snap-fit, adhesive, and/or engagement by one or more engagement features. In the illustrated implementation, the lower valve 106(*a*) may include ribs to couple to the upper valve 110.

The sleeve 102, the end cap 104, the lower valve 106(*a*), the upper valve 110, and the attachment seat 112, may be constructed of materials including, but not limited to, wood, plastics, polymers, thermoplastics, composites thereof, or the like. In some implementations, the sleeve 102, the end cap 104, the lower valve 106(*a*), the upper valve 110, and the attachment seat 112 may be made at least partially of a resin such as, for example, acrylonitrile butadiene styrene (ABS), styrene acrylonitrile (SAN), pentachlorothioanisole (PCTA), polypropylene (PP), polyethylene (PE), Polyurethane, combinations thereof, or the like.

The dispenser with the moving assembly with encased valve may include a lock type mechanism to avoid accidentally moving the dispenser along the shaped path. For example, the dispenser will not selectively move from the upward open state to the downward closed state and vice versa, unless a user manually moves the sleeve or another mechanism on the dispenser. For ease of convenience, the term "dispenser with the moving assembly with encased valve" may be used interchangeably with the versions of "dispenser with moving assembly" or "moving assembly".

Illustrative Applicator and Cap for Dispenser with Moving Assembly

FIG. 1 shows the dispenser with the moving assembly with encased valve 100, which includes an attachment fixture 114 that is coupled to the attachment seat 112 and the upper valve 110. The attachment fixture 114 includes at least one aperture selectively alignable with the at least one pipe from the attachment seat 112 for product delivery. The attachment fixture 114 may include at least one aperture that would function as sleeves to go over the pipes on the attachment seat 112 of the upper valve 110.

In implementations without any pipes, the attachment fixture 114 may include at least one aperture that aligns with the at least one aperture in the attachment seat 112. The aperture may range in number from at least about one to at most about six apertures. The aperture may range in size from at least about 2 mm to at most about 4 mm in diameter. The number and diameter size of the apertures in the attachment fixture 114 may match the number and diameter size of the apertures or pipes in the attachment seat 112.

The attachment fixture 114 is coupled to a bottom of an applicator 116. The applicator 116 may include but is not limited to, a brush, a sponge, or a powder puff to apply the product. In some implementations, the applicator may be used to apply products including but not limited to, cosmetic powdered products, gel or lotion products, and the like.

As mentioned, the dispenser 100 is capable of being selectively guidable along the shaped path to the upper right position. This upward position allows the applicator 116 to be selectively guidable to be raised or exposed to deliver product. Also, the dispenser 100 is capable of being selectively guidable along the shaped path to the downward position. This downward position allows the applicator 116 to be selectively retractable for storing the dispenser, not providing a delivery mechanism.

The dispenser with the moving assembly with encased valve 100 may include a removable cap 118 or a cover that is sized and shaped to fit over the top of the brush applicator 116. In an implementation, the removable cap 118 may snap onto the sleeve. In another implementation, the removable cap 118 may include threads to screw onto the sleeve that mates with it. In other implementations, the dispenser with the moving assembly with encased valve 100 may include a clear plastic cover, a sliding pull up cover, and the like. In this illustration, the dispenser 100 includes the removable cap 118 that encapsulates the brush applicator 116 when the dispenser 100 is not in use. In another implementation, the dispenser 100 may not include a removable cap or cover.

The removable cap 118 may include a mirror (not shown) for convenience of the user to have the mirror readily available when applying the product. The mirror may range in thickness from at least about two mm to at most about eight mm. The mirror may be located on the top, the side, or inside the removable cap 118. In another implementation, the dispenser 100 may not include a mirror.

While features of various illustrative implementations are described, in other implementations, the sleeve 102, the end cap 104, the lower valve 106(*a*), the upper valve 110, the attachment fixture 114, the brush applicator 116, the removable cap 118, and the mirror may be configured in any form suitable for the application of the product contained in dispenser 100. For example, the above items listed may be constructed in any other suitable shape and size and may have any suitable mass, surface finish, and/or surface treatment desired for a given application. In practice, the above items listed may be configured in virtually any desired shape, such as disk-shaped, oval, elliptical, spherical, curvilinear, trapezoidal, or the like.

Illustrative Shaped-Configurations for Dispenser with Moving Assembly

Figure 2:
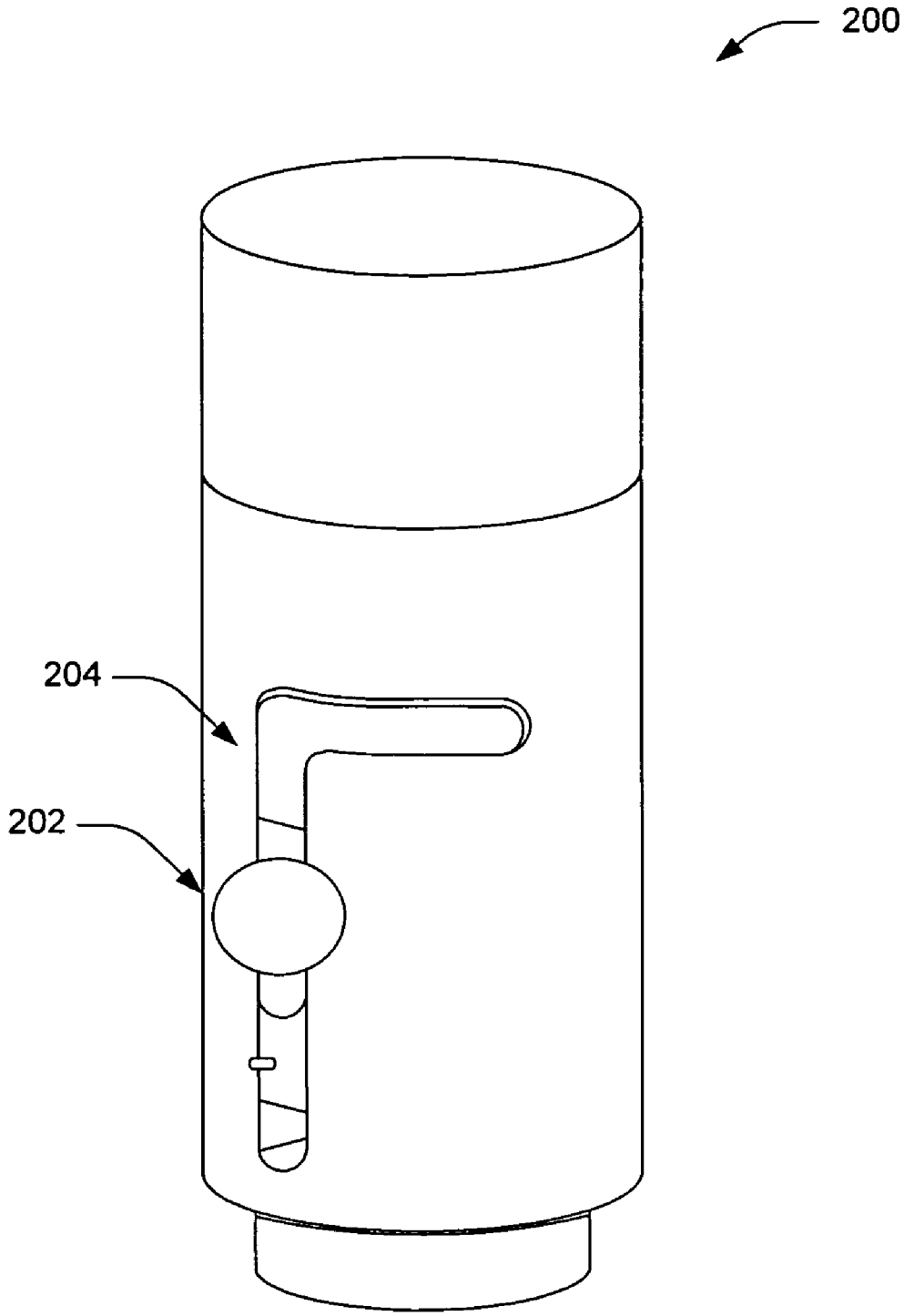
FIG. 2 is a front perspective view of the dispenser with a moving assembly with encased valve according to the implementation of FIG. 1.

FIG. 2 is a front perspective view of the dispenser 200 with a moving assembly with encased valve according to the implementation of FIG. 1. The following is a discussion of examples, without limitation, of delivery mechanisms for dispensing a product being selectively guidable along the shaped path between the upward position and the downward position. The upward position is the open state to deliver product and the downward position is the closed state to store the dispenser. The positions may also be referred to as raised and retracted positions.

Actuation may occur by turning, depressing, sliding, tilting, or otherwise manipulating an outer cover, a knob on an outer cover, guide pins, a button, a rotating sleeve, a pull up sleeve, and/or by any other suitable dispensing mechanism. The examples may be implemented with these mechanisms using a slide up or down in combination with a turning rotation either to the right or to the left, a single or a multiple slide operation, a single or multiple push mechanism, a rotation or a reverse rotation operation, a clockwise or a counterclockwise direction, a left rotation or a right rotation, vice versa, whereby a user may operate the dispenser 200.

In one implementation, the user moves a button, serving as a guide pin. The button is coupled to the upper guide pin which is connected to the upper valve. The upper valve is further coupled to the lower valve. The user moves the button, which may selectively move the assembly in the raised position or the retracted position. This implementation includes being selectively moveable between the open state defining a delivery passageway for a product and the closed state which stores the dispenser.

Other implementations may be used. For example, the user selectively moves the button which may be coupled to the lower guide pin along the shaped path, while the upper valve, respectively, remains stationary.

FIG. 2 shows the dispenser 200 with a button 202 to operate the mechanism along an L-shape configuration 204. The user may selectively push the button 202 to the upward position or the downward position. The button 202 coupled to the upper valve 110 extends into the inverse L-shape configuration of the sleeve 114 and is guided along this path. During manipulation by the user, the button 202 coupled to the upper valve 110 travels along the L-shape configuration to the upward position. Guided by the button 202, the assembly which includes the lower valve 106(*a*), the flow-through gasket, and the upper valve 110, is moving in the upward motion. When the user moves the button 202 along the L-shape configuration to the upper right portion, the upper valve 110 is selectively rotatable toward this path. The motion into the inverse L-shape configuration misaligns or rotates the button 202 away from a lower guide pin. However, this motion then selectively aligns the at least one aperture in the upper valve to align with the at least one aperture in the flow-through gasket and with the at least one aperture in the lower valve seat (the lower valve and the flow-through gasket are already aligned). This alignment creates the open state for product delivery. In this upward raised position and open state, the applicator is exposed or raised for use. Yet in other implementations, there may not be a flow-through gasket as part of the assembly.

The L-shape configuration may range from a length of about at least about 25 mm to at most about 60 mm and range in diameter from at least about three mm to at most about ten mm. Other guide shapes, sizes, and configurations may be used for the different implementations. Others include but are not limited to a substantially J-shape, a substantially Y-shape, a substantially forked-shape, substantially 90 to 120 degrees, and the like. However, in other implementations, any suitable configuration, variation, or reflection of the shape configurations may be used.

Figure 3A:
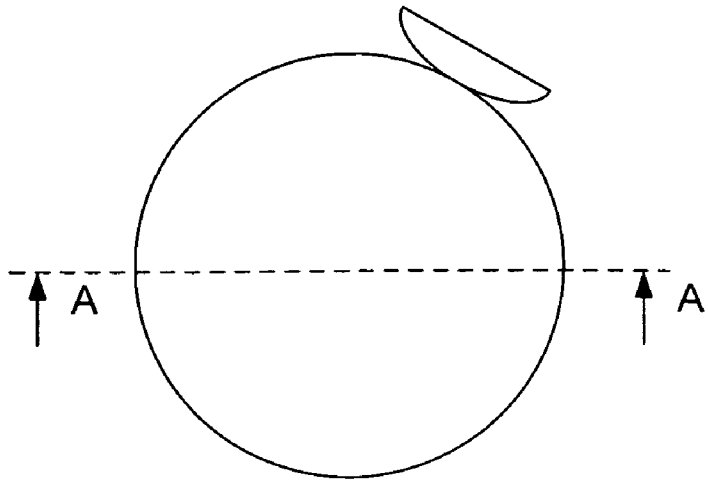
FIGS. 3*a* and 3*b* are top plan views taken along line A-A for a moving assembly with encased valve shown with a cap and without a cap, respectively, according to the implementation of FIG. 1.
Figure 3B:
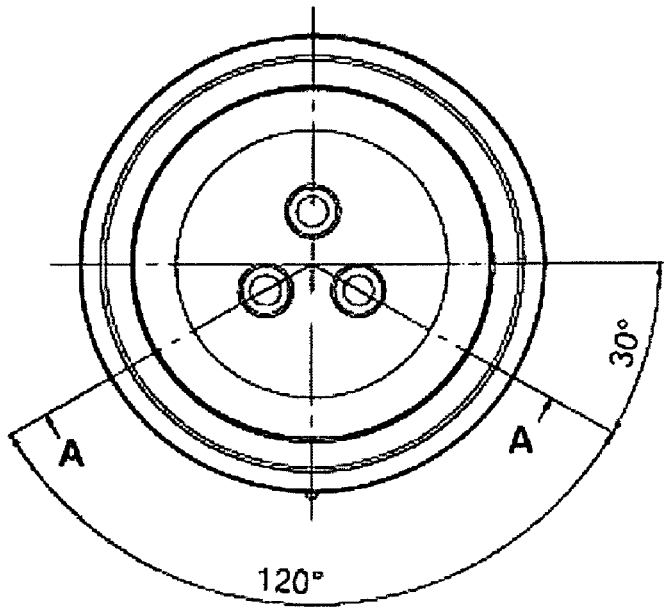

FIGS. 3*a* and 3*b* are top plan views taken along line A-A for a moving assembly with encased valve shown with a cap and without a cap, respectively, according to the implementation of FIG. 1

Illustrative Delivery Mechanism for Dispenser with the Moving Assembly

Figure 4A:
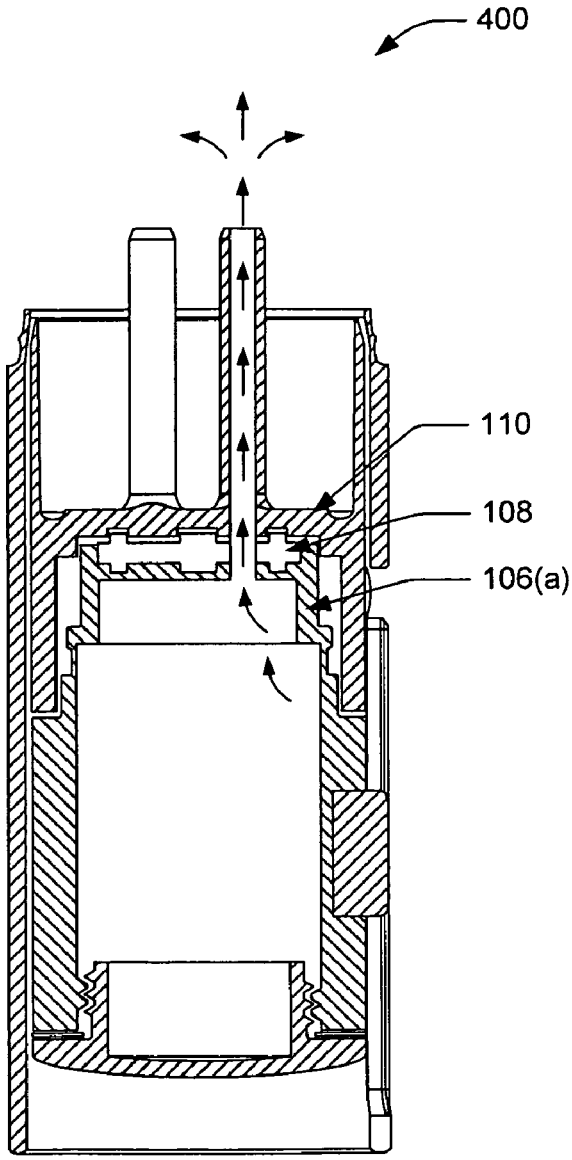
FIGS. 4*a* and 4*b* are cross-sectional views of the dispenser with the moving assembly with encased valve of FIG. 1 shown with a cap and without a cap, respectively, taken along line A-A of FIG. 3.
Figure 4B:
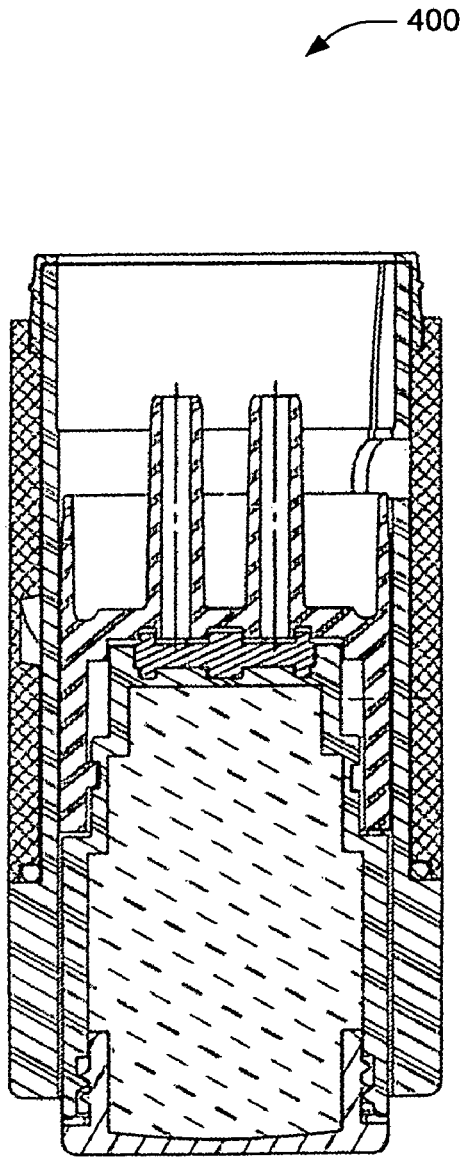

FIGS. 4*a* and 4*b* are cross-sectional views of the dispenser with the moving assembly with encased valve of FIG. 1, shown with a cap and without a cap, respectively, taken along line A-A of FIG. 3. As shown in the cross sectional view for FIG. 4*a*, the flow-through dispenser 400 illustrates an assembly of the lower valve 106(*a*), the flow-through gasket 108, and the upper valve 110. In implementations, the flow-through gasket 108 moves vertically as selectively guided between the upward and downward positions. However, in other implementations, there may not be a flow-through gasket.

Shown in FIG. 4*a* is how a product delivery passageway extends from the reservoir in the lower valve 106(*a*) and terminates in the plurality of pipes. In one example, the upper valve 110 serves as an operating mechanism to allow product delivery in the open state. The upper valve 110 being selectively guidable along the shaped path to the upward position which is the open state. As mentioned previously, this open state causes a plurality of pipes or apertures in the upper valve 110 to be selectively alignable with a plurality of apertures of the flow-through gasket 108 and with the plurality of apertures in the lower valve 106(*a*), such that the product is transported through this product delivery passageway. Thus, the product is dispensed from the reservoir in the lower valve 106(*a*) through the plurality of apertures in the lower valve 106(*a*) through the plurality of apertures in the flow-through gasket 108 and through a plurality of pipes or a plurality of apertures in the upper valve 110.

Shown in FIG. 4*b* is the assembly of the lower valve 106(*a*) and the upper valve 110, which are selectively guidable downward and the applicator brush (not shown) which would selectively retract into the downward position. This downward position stores the dispenser. Also, in this downward position, there is no product leakage as there is not a delivery passageway. A downward motion may cause the plurality of raised sections in the upper valve 110 to be selectively alignable with the plurality of apertures in the flow-through gasket 108 to prevent product leakage. In this closed state, there is no product leakage by not defining a product delivery passageway.

Illustrative Flow-Through Gasket for Dispenser with Moving Assembly

Figure 5A:
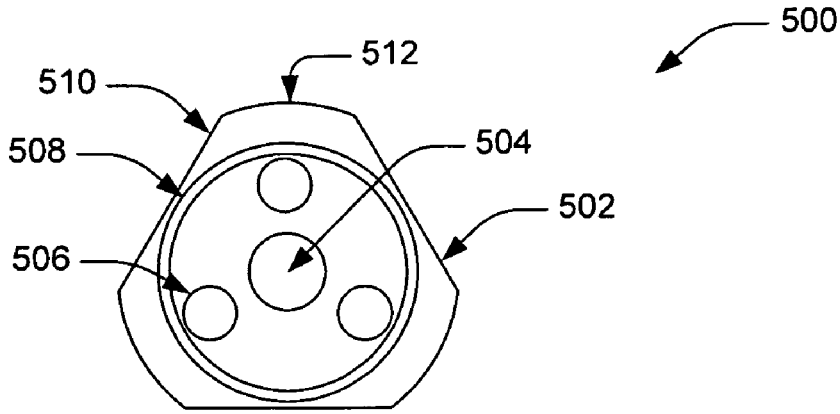
FIGS. 5*a*, 5*b*, and 5*c* are a bottom view, a top plan view, and a perspective plan view respectively, of an illustrative flow-through gasket according to one implementation.
Figure 5B:
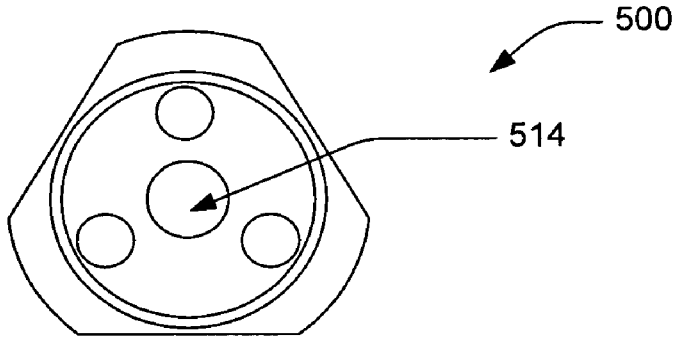
Figure 5C:
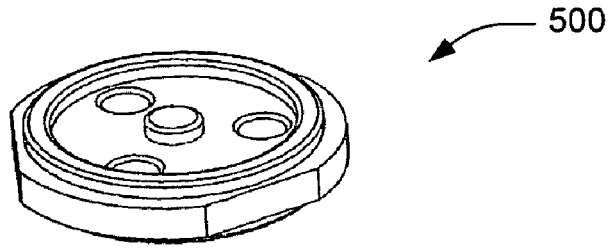

FIGS. 5*a*, 5*b*, and 5*c* are a bottom view, a top plan view, and a perspective view respectively, of an illustrative flow-through gasket according to one implementation. FIG. 5*a* illustrates the flow-through gasket 500 having a substantially disk-shaped body 502 with a top raised center section on a top side 504. The top raised center section 504 may be substantially circular-shape, substantially square-shape, or substantially oval-shape. In this diagram, the top raised center section 504 is substantially circular-shape.

FIG. 5*a* shows the plurality of apertures 506 located on the substantially disk-shaped body 502. The plurality of apertures 506 is selectively alignable with the plurality of apertures of the lower valve 106(*a*) and with the plurality of pipes or with the plurality of apertures in the upper valve 110 to deliver the product. The apertures 506 in the flow-through gasket 500 may have shapes that includes but are not limited to, substantially circular-shape, substantially square-shape, or substantially oval-shape. Shown are apertures 506 that are substantially circular-shape.

The size of the plurality of apertures 506 are of a sufficient size to allow for product delivery without being plugged. The size of the aperture is of an adequate opening to allow the powdered particles to travel through the plurality of apertures 506. For example, the size of the apertures 506 in the flow-through gasket 500 may range from at least about 1 mm to at most about 6 mm. In one implementation, the aperture 506 is at least about 2 mm diameter in size.

The number of the plurality of apertures 506 is of a sufficient number to allow for product delivery in the open position, but is somewhat dependent on the size of the apertures. In an implementation, there may be three apertures as shown.

In other implementations, the apertures may include but is not limited to, from at least about one aperture to at most about four apertures.

The arrangement of the apertures 506 may be in a triangular configuration as shown. In another implementation, the arrangement may be in various configurations, including but not limited to a square or a circular configuration. In one implementation, there may be three apertures spaced at 120 degrees apart from each other while in another implementation, there may be four apertures spaced at 90 degrees apart from each other.

The substantially disk-shaped body 502 includes a circular ring 508 on each side of the disk-shaped body 502. In one implementation, a first circular ring surrounds the apertures and is to couple to the mouth of the lower valve 106(*a*) on one side and a second circular ring surrounds the apertures and is to couple to the upper valve 110 on the outer side.

The flow-through gasket 500 includes an outer perimeter having a plurality of flat sides 510 and a plurality of semicircular sides 512, alternating, on the substantially disk-shape body. The plurality of semicircular sides 512 holds the flow-through gasket 500 secure against the upper valve 110 or the lower valve 106(*a*) upon actuation in the various implementations. The plurality of flat sides 510 may apply to any sides of the substantially disk-shaped body 502. For example, the flat sides 510 may include, but is not limited to three sides arranged in a triangle type formation or configuration. The semicircular side 512 may apply to any sides of the substantially disk-shaped body 502.

The semicircular sides 512 arranged in a triangle type formation or configuration. In an implementation, the substantially disk-shaped body 502 may include alternating flat sides 510 with alternating semicircular sides 512. The number of semicircular sides and flat sides may each range from at least about one to the most about four.

FIG. 5*b* shows the other side of the substantially disk-shaped body 502 of the flow-through gasket. The center raised section 514 in the flow-through gasket 500 may be substantially squared-shape. The center-raised section 514 may have shapes that includes but are not limited to, substantially circular-shape, substantially square-shape, or substantially oval-shape.

FIG. 5*c* shows a perspective view of the flow-through gasket 500. The flow-through gasket 500 is made of a material capable of having elastomeric properties. The materials include but are not limited to, a thermoplastic elastomer (TPE), a thermoplastic polymer, a polyvinyl chloride, a polyurethane, polyester copolymer, styrene copolymer, olefin, ethylene acrylic, chlorinated polyethylene, chlorosulfonated polyethylene, fluorocarbon, rubber, while in other implementations, the elastomeric material may comprise a relatively pliable or gel-like material such as butyl rubber, silicone, butadiene rubber, neoprene, nitrile, fluorosilicone, styrene-butadiene rubber (SBR), or the like.

In an implementation, the flow-through gasket is formed integrally with the lower valve 106(*a*). The two components would be formed as one piece, but the flow-through gasket 500 would be formed of one of the materials as identified above while the lower valve 106(*a*) would be formed from the list of materials as previously discussed. In another implementation, the flow-through gasket is formed integrally with the upper valve, each formed of different materials.

While features of various illustrative implementations are described, in other implementations, the flow-through gasket 500 may be configured in any form suitable for the application of the product contained in the dispenser. For example, the flow-through gasket 500 may be constructed in any other suitable shape and size and may have any suitable number of apertures, size of apertures, shape of apertures desired for a given application. The size, number, and shape of the apertures on the flow-through gasket 500 may vary between implementations. Fabrication of the dispenser and the flow-through gasket 500 may be accomplished through a separate manufacturing process, a co-molding process, or any other suitable production process.

Illustrative Moving Assembly Dispensers with Different Shaped-Configurations

FIGS. 6-11 illustrate other implementations of the moving assembly dispenser. It is understood these illustrative dispensers with moving assembly have features similar to the components and features of the dispensers as discussed for FIGS. 1-4. However, the following descriptions will focus on features that are different for other implementations of the moving assembly dispensers. The implementations may refer to the various positions as upward and downward, first, second, third, or fourth positions, without reference to any particular order.

In some implementations, there is a product dispenser having a lower valve, an upper valve, and a sleeve having the shaped path. A user moves a mechanism, such as the sleeve connected to an upper guide pin on an upper valve and to a lower guide pin on the lower valve, to move the assembly to the upward position or the downward position along the shaped path. The upward position may include an extended state to hold the applicator in place and/or an open state to deliver the product. The downward position is a closed state to retract the applicator. Yet in other implementations, there may be a flow-through gasket located between the upper valve and the lower valve.

Figure 6:
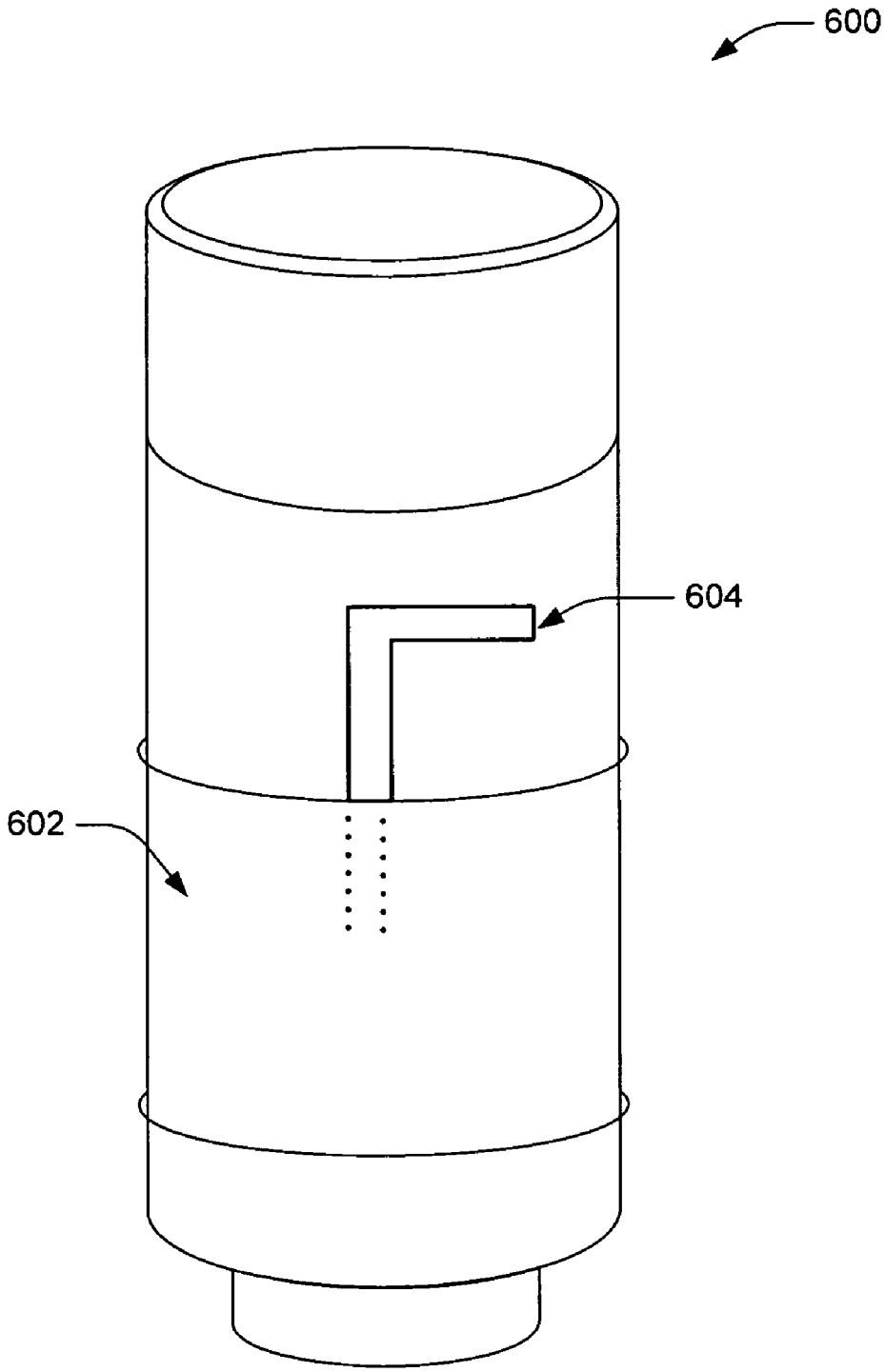
FIG. 6 is a front perspective view of an illustrative dispenser with a moving assembly with encased valve according to another implementation.

FIG. 6 is a perspective front view of an illustrative moving assembly dispenser shown with a cap 600 in a closed configuration according to one implementation. In this implementation for FIG. 6, the dispenser 600 includes a sleeve 602 that has an L-shape configuration 604. In this implementation, the mechanism involves the sleeve 602 sliding up and rotating along the L-shape configuration 604. However, in other implementations, there may be variations or reflections of the L-shape configuration.

Figure 7A:
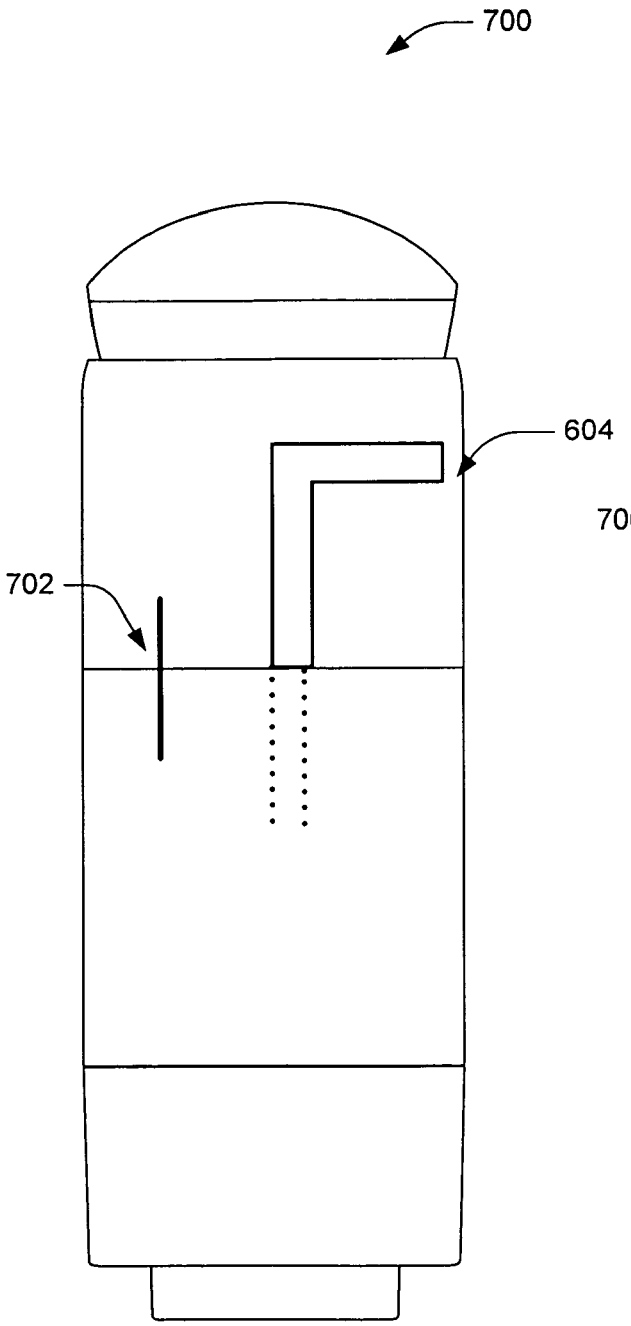
FIGS. 7*a* and 7*b* are front perspective views of the dispenser with a moving assembly with encased valve according to the implementation of FIG. 6.
Figure 7B:
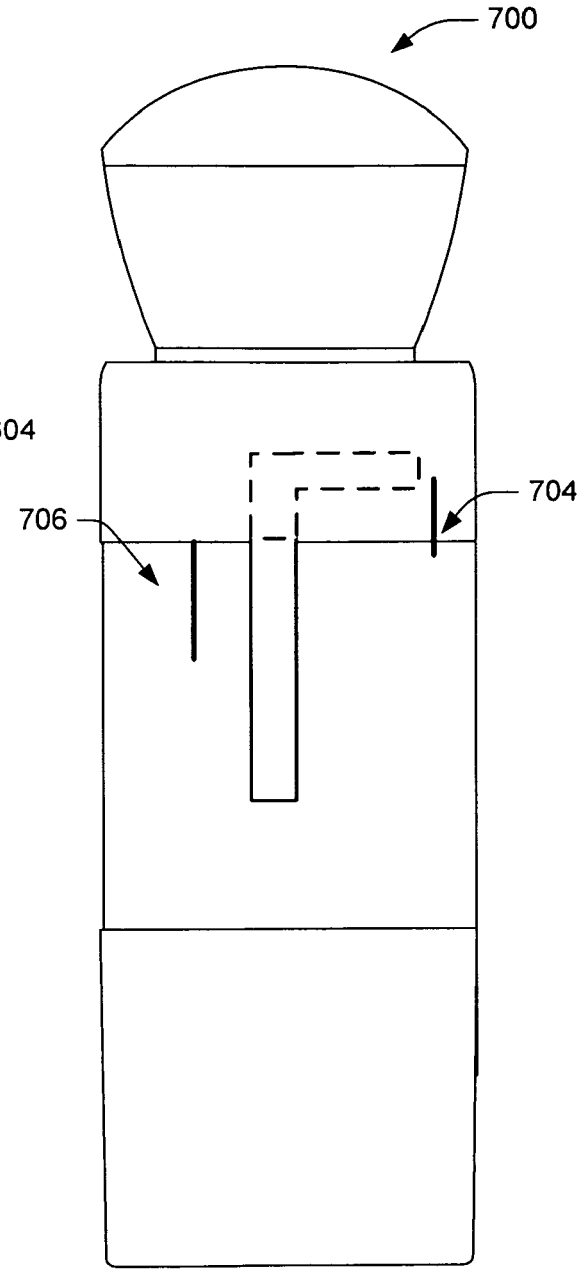

FIGS. 7*a* and 7*b* are front views of the moving assembly dispenser shown without the cap 700 in an open configuration, according to the implementation of FIG. 6. FIG. 7*a* illustrates the dispenser 700 with the moving assembly in the downward position. In this downward position, the applicator is in the retracted position. Shown at 702, are markings to indicate the upper valve and the lower valve are aligned. The L-shape configuration or path 604 helps guide the assembly to travel along this path. FIG. 7*b* illustrates the dispenser 700 with the moving assembly in the upward position or first position. In this upward or first position, the applicator is in the raised position. As shown in FIG. 7*b*, the marking 704 indicate the upper valve is no longer aligned with the marking 706 on the lower valve. However, in this upward or first position, the at least one aperture in the upper valve is aligned with the at least one aperture in the lower valve to deliver product. In some implementations with a flow-through gasket, the flow-through gasket is also alignable with the at least one aperture of the upper valve and with the at least one aperture of the lower valve for product delivery.

Figure 8:
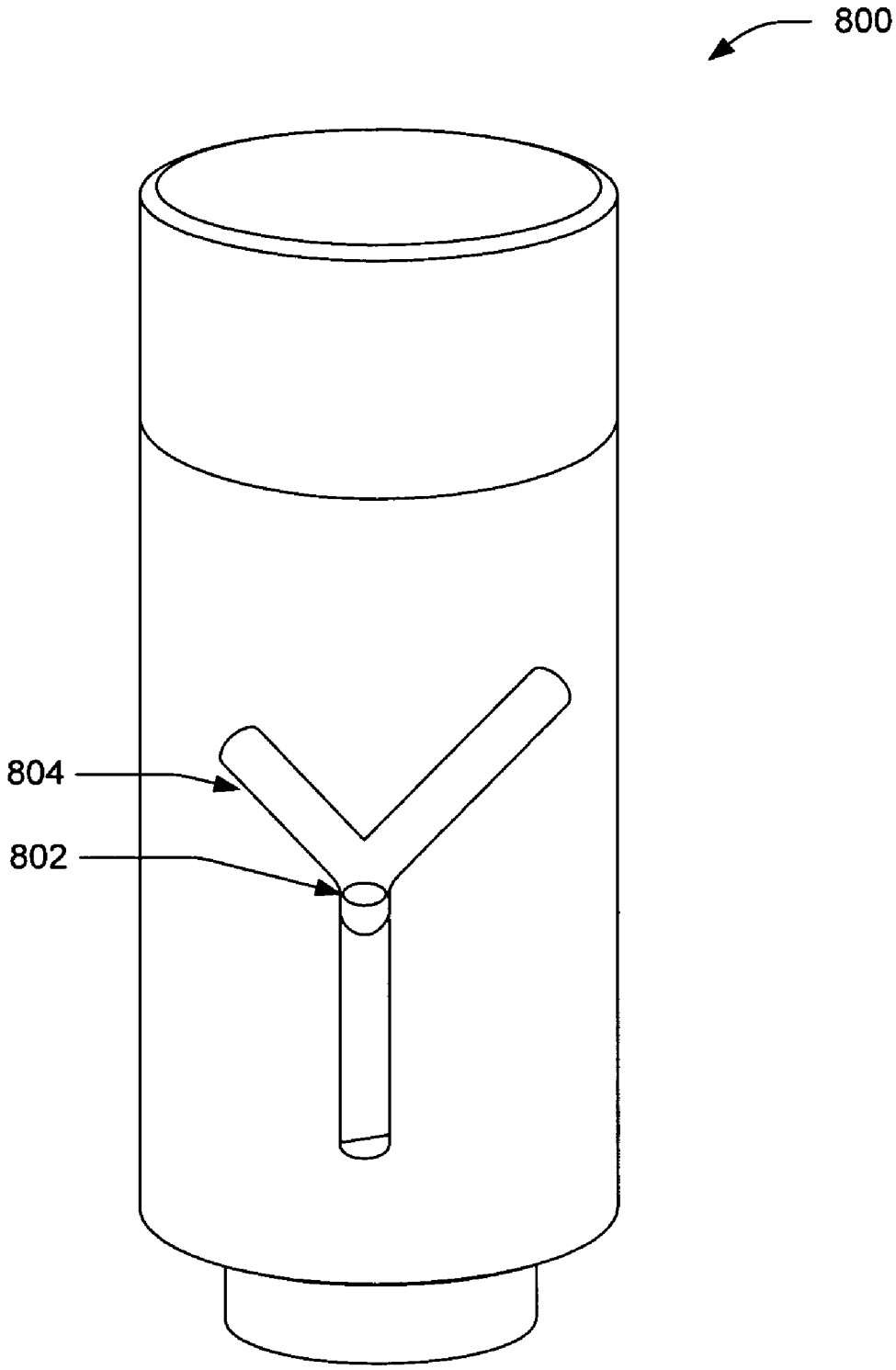
FIG. 8 is a front view of an illustrative dispenser with a moving assembly with encased valve according to yet another implementation.

FIG. 8 is a front perspective view of an illustrative moving assembly dispenser shown with the cap 800 in the closed configuration according to yet another implementation. In this implementation for FIG. 8, the dispenser 800 includes a button 802 that is selectively guidable along a Y-shape configuration 804. The mechanism for the Y-shape configuration 804 is a slide up and to the right side or to the left side of the Y-shape configuration.

Figure 9A:
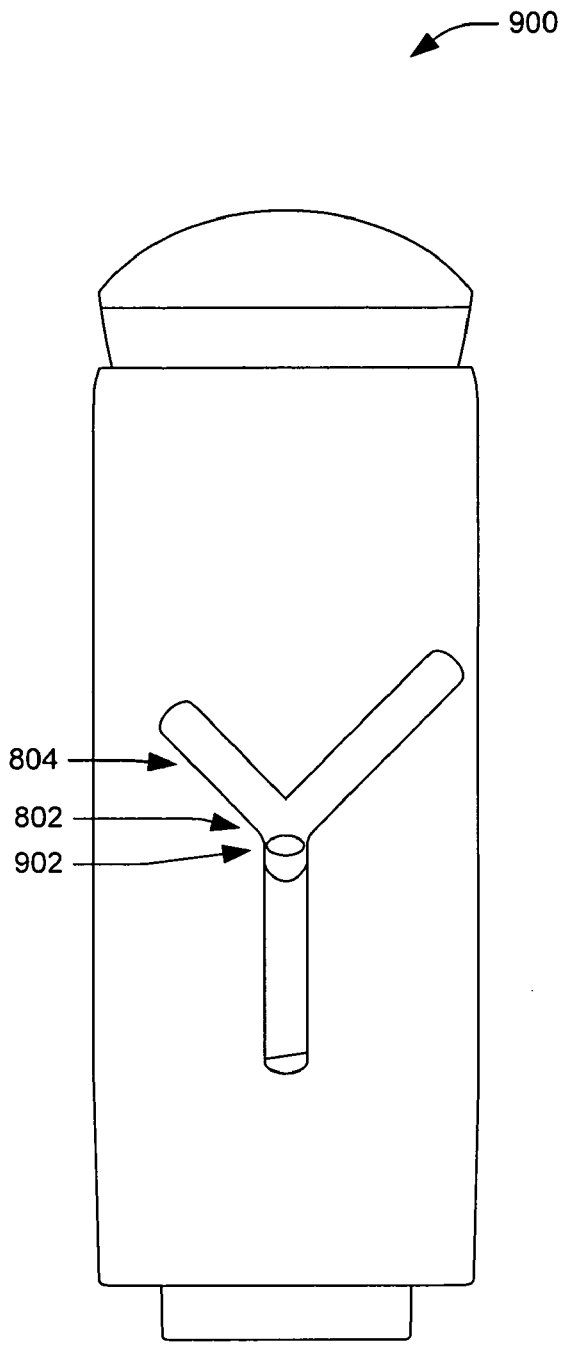
FIGS. 9*a* and 9*b* are front views of the dispenser with a moving assembly with encased valve according to the implementation of FIG. 8.
Figure 9B:
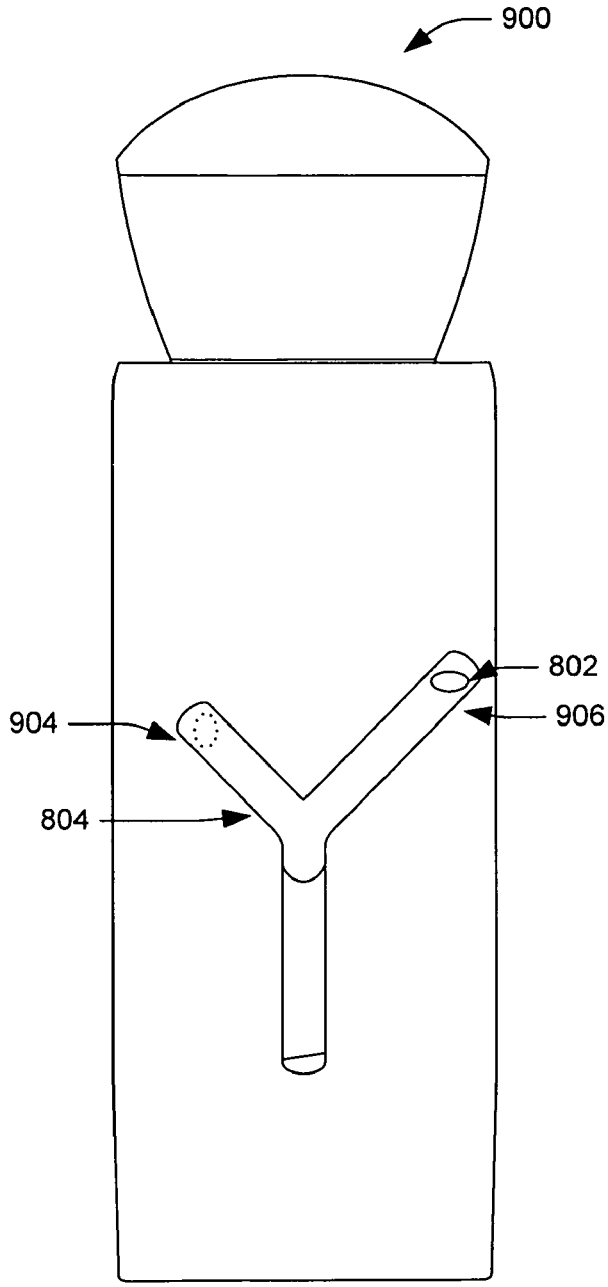

FIGS. 9*a* and 9*b* are front views of the illustrative moving assembly dispenser 900 shown without the cap in the open configuration according to the implementation of FIG. 8. FIG. 9*a* illustrates the button 802 is initially located at a position 902 that connects the right and left portions of the Y-shape configuration 804. At this button location 902, the dispenser is in the downward position for no product delivery. Here, the applicator is in the retracted position. FIG. 9*b* illustrates how the user may selectively guide the button 802 along the Y-shape configuration to the left upper portion 904 (shown in dotted lines). In this first position 904, the dispenser is in an extended state which holds the applicator in place in a raised position. FIG. 9*b* further illustrates the user may selectively guide the button 802 along the Y-shape configuration 804 to the right upper portion 906. In this second position 906, the dispenser is in the upward position which is the open state to deliver product. In this position 906, the at least one aperture in the upper valve is selectively alignable with the at least on aperture in the lower valve. In some implementations with a flow-through gasket, the flow-through gasket is also alignable with the at least one aperture of the upper valve and with the at least one aperture of the lower valve for product delivery.

Figure 10:
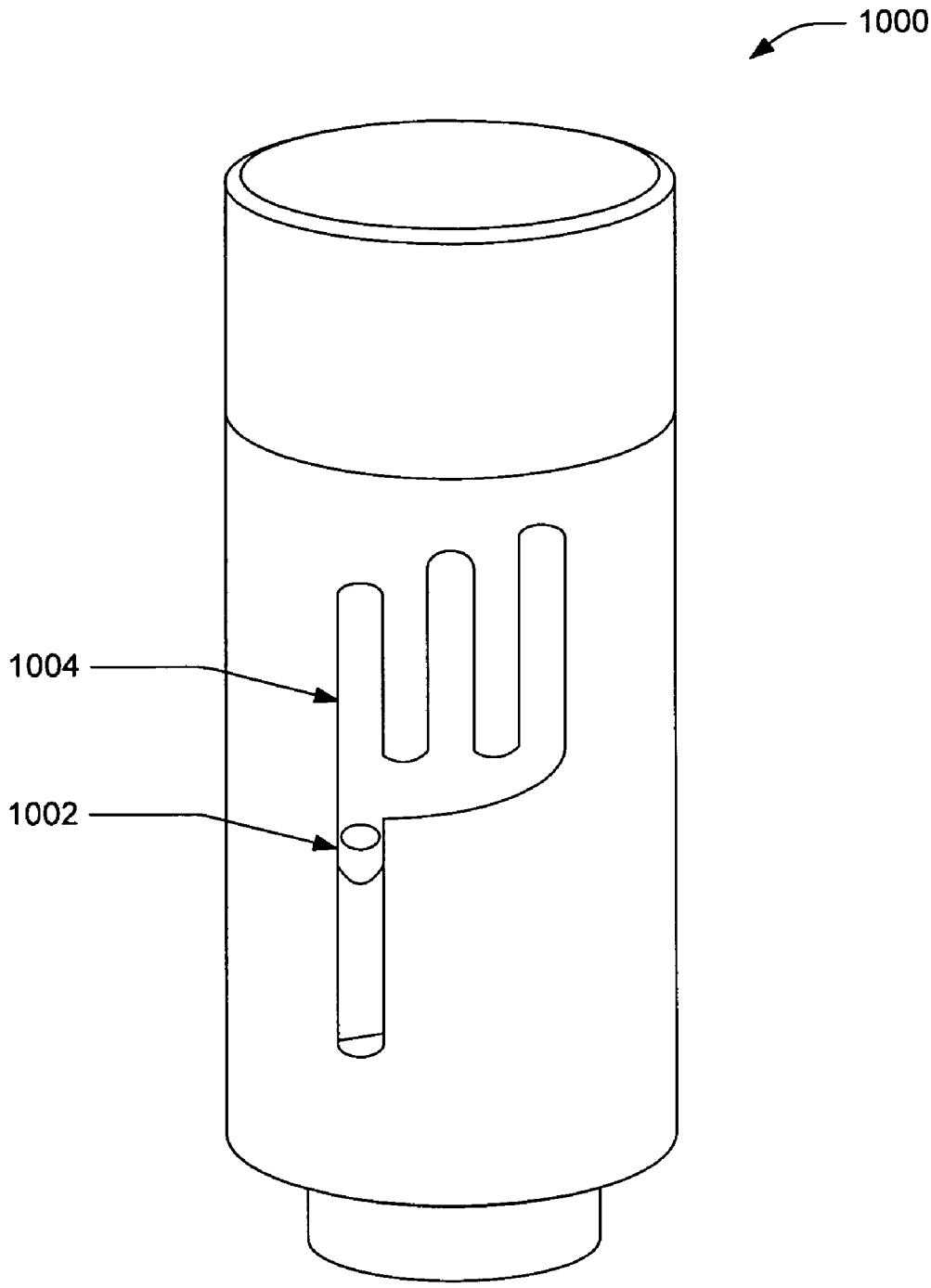
FIG. 10 is a front perspective view of an illustrative dispenser with a moving assembly with encased valve according to another implementation.

FIG. 10 is a front view of an illustrative moving assembly dispenser shown with the cap 1000 in the closed configuration according to yet another implementation. In this implementation for FIG. 10, the dispenser 1000 includes a button 1002 that is selectively guidable along a forked-shape configuration 1004. The forked-shape configuration 1004 many have one to five prongs. In this implementation, the forked-shape configuration 1004 is shown with three prongs. In this implementation, the mechanism involves multiple slide positions along the forked-shape configuration for the dispenser. Any radial motion will cause the apertures in the upper and lower valves to align or misalign. This radial motion controls the product flow. In certain implementations, there is a flow-through gasket that is also alignable with the at least one aperture of the upper valve and with the at least aperture of the lower valve.

Figure 11A:
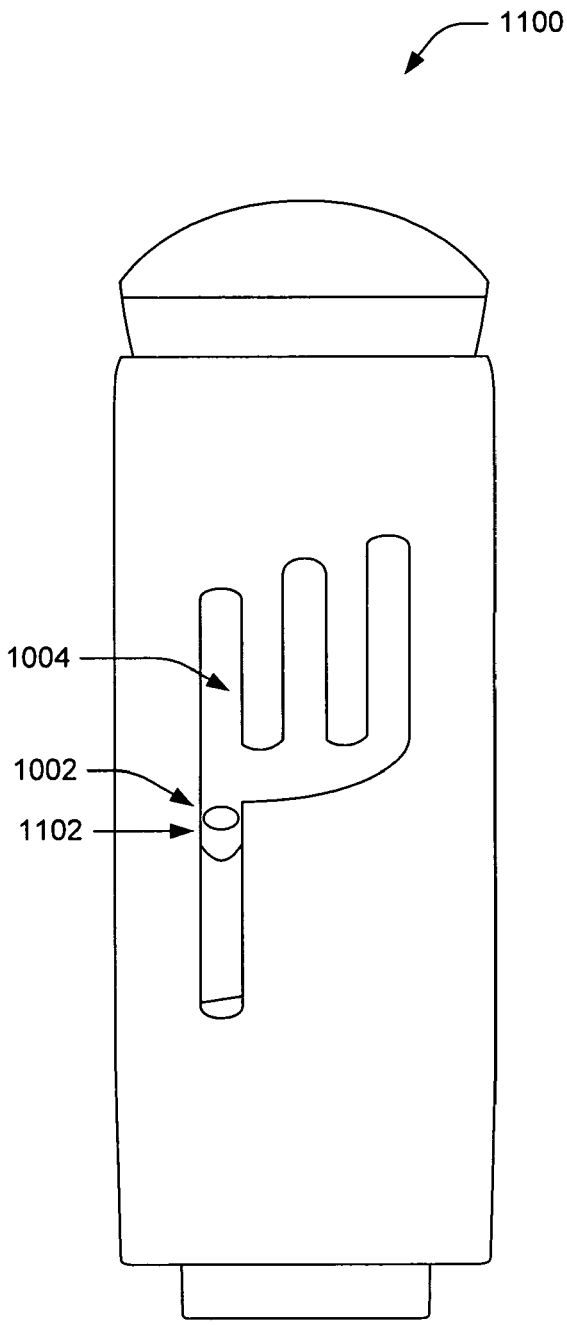
FIGS. 11*a* and 11*b* are front views of the dispenser with a moving assembly with encased valve according to the implementation of FIG. 10.
Figure 11B:
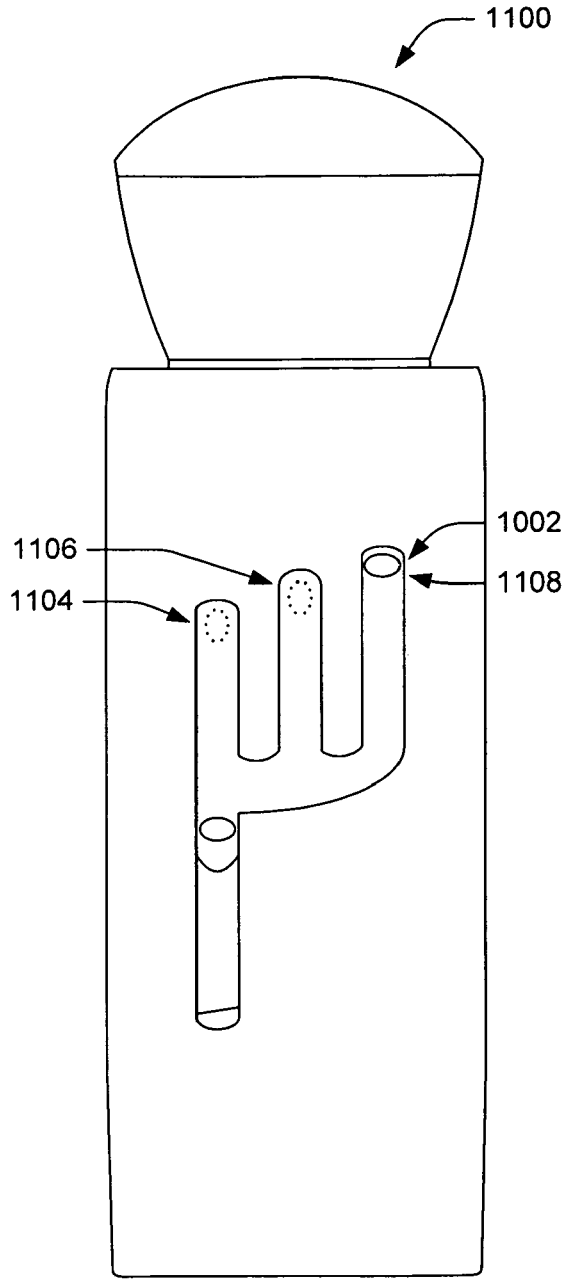

FIGS. 11*a* and 11*b* are front views of the moving assembly dispenser shown without the cap 1100 in the open configuration, according to the implementation of FIG. 10. FIG. 11*a* illustrates the button 1002 is located at a lower left position 1102 of the forked-shape configuration 1004. At this location 1102, the dispenser 1100 is in the downward position to retract the brush and no product flow. Here, the applicator is in the retracted position.

FIG. 11*b* illustrates how the user may selectively guide the button 1002 in the upward position along right upper position 1104 of the forked-shape configuration for the dispenser 1100. The right upper position 1104 is shown in dotted lines for illustrative purposes. In this first position 1104, the brush is extended in the upward position and the applicator is held in place. The dispenser 1100 has the brush in the extended state to hold the applicator in the raised position. In this position 1104, no product is being dispensed.

FIG. 11*b* illustrates how the user may selectively guide the button 1002 in the upward position along a middle portion or a middle prong position 1106 of the forked-shape configuration for the dispenser 1100. The middle prong position 1106 is shown in dotted lines for illustrative purposes. In this second position 1106, the dispenser 1100 is in an upward position, the brush is extended partially, and the dispenser is in a partially open state to deliver product partially, not fully opened when in position 1106. The dispenser 1100 may be in the extended state to hold the applicator in the raised position. In this position 1106, the at least one aperture in the upper valve is partially selectively alignable with the at least on aperture in the lower valve. In some implementations with a flow-through gasket, the flow-through gasket is also partially selectively alignable with the at least one aperture of the upper valve and with the at least one aperture of the lower valve for product delivery.

FIG. 11*b* also illustrates the user may selectively guide the button 1002 located in the right upper portion or a right prong position 1108 of the forked-shape configuration. In this third position 1108, the dispenser 1100 is in the upward position, the brush is fully extended, and the dispenser is in a fully open state to deliver product, as fully opened. In this third position 1108, the at least one aperture in the upper valve is selectively alignable with the at least on aperture in the lower valve. In some implementations with a flow-through gasket, the flow-through gasket is also selectively alignable with the at least one aperture of the upper valve and with the at least one aperture of the lower valve for product delivery.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention.

What is claimed is:

1. A cosmetic dispenser comprising:

a lower valve having a reservoir for containing a product, the lower valve having at least one aperture;

an upper valve coupled to the lower valve, the upper valve having at least one aperture;

a flow-through gasket interposed between the lower valve and the upper valve, the flow-through gasket comprising:

a top raised center section on a top side and a bottom raised center section on a bottom side;

at least one aperture being located on a substantially disk-shaped body and being alignable with the at least one aperture of the lower valve and with the at least one aperture of the upper valve to define a delivery passageway for the product;

a first circular ring surrounding the at least one aperture on the bottom side of the substantially disk-shaped body, the first circular ring to couple the flow-through gasket to the lower valve;

a second circular ring surrounding the at least one aperture on the top side of the substantially disk-shaped body, the second circular ring to couple the flow-through gasket to the upper valve; and an outer perimeter comprising a plurality of flat sides and a plurality of semicircular sides alternating on the substantially disk-shaped body, the plurality of semicircular sides to hold the flow-through gasket in place when actuation occurs;

a sleeve partially covering the lower valve and the upper valve, the sleeve having a shaped path;

the lower valve and the upper valve being selectively guidable along the shaped path between:

i) an upward position for the dispenser to deliver the product, and ii) a downward position to store the dispenser; and an applicator coupled to the upper valve for applying the product.

2. The cosmetic dispenser of claim 1, wherein the shaped path in the sleeve comprises at least one of a substantially J-shape configuration, a substantially L-shape configuration, a substantially T-shape configuration, a substantially forked-shape configuration, or a substantially Y-shape configuration.

3. The cosmetic dispenser of claim 1, further comprising a guide pin located on the upper valve, the guide pin being selectively guidable along the shaped path to selectively move the upper valve and the lower valve between:

i) a first position along the shaped path for the dispenser to be in an open state to deliver the product, and ii) a second position along the shaped path for the dispenser to be in a closed state to retract the applicator.

4. The cosmetic dispenser of claim 1, further comprising a guide pin located on the upper valve, the guide pin being selectively guidable along a substantially L-shape configuration to selectively move the upper valve and the lower valve between:

i) a first position in which the dispenser is in an extended state to hold the applicator in place and in an open state to deliver the product; and ii) a second position in which the dispenser is in a retracted state with the applicator retracted and in a closed state to seal the product in the reservoir.

5. The cosmetic dispenser of claim 1, further comprising a guide pin located on the upper valve, the guide pin being selectively guidable along a substantially Y-shape configuration to selectively move the upper valve and the lower valve, the guide pin being selectively guidable between:

i) a first position in which the dispenser is in an extended state to hold the applicator in place;

ii) a second position in which the dispenser is in the extended state and an open state to deliver the product; and iii) a third position in which the dispenser is in a retracted state with the applicator retracted and in a closed state to seal the product in the reservoir.

6. The cosmetic dispenser of claim 1, further comprising a guide pin located on the upper valve, the guide pin being selectively guidable along a substantially forked-shape configuration to selectively move the upper valve and the lower valve between:

i) a first position in which the dispenser is in an extended state to hold the applicator in place;

ii) a second position in which the dispenser is in the extended state and a partially open state to deliver the product;

iii) a third position in which the dispenser is in the extended state and a fully open state to deliver the product; and iv) a fourth position in which the dispenser is in a retracted state with the applicator retracted and in a closed state to seal the product in the reservoir.

7. The cosmetic dispenser of claim 1, further comprising a flow-through gasket coupled between the lower valve and the upper valve, the flow-through gasket comprising:

a substantially disk-shaped elastomeric body.

8. The cosmetic dispenser of claim 1, wherein the at least one aperture in the flow-through gasket comprises a substantially circular-shape, a substantially square-shape, or a substantially oval-shape.

9. The cosmetic dispenser of claim 7, wherein the flow-through gasket moves vertically as the upper and the lower valves are moved between the upward and the downward positions.

10. The cosmetic dispenser of claim 1, wherein the upper valve comprises at least one pipe for product delivery.

11. A dispenser comprising:

a lower valve having a reservoir for containing a product, the lower valve having at least one aperture;

an upper valve coupled to the lower valve, the upper valve having at least one aperture, the upper valve and the lower valve being selectively moveable between a raised position and a retracted position;

a sleeve covering the upper valve and the lower valve, the sleeve having a shaped path;

the upper valve and the lower valve being selectively guidable along the shaped path of the sleeve between the raised position and the retracted position;

an applicator coupled to the upper valve for applying the product; and a flow-through gasket interposed between the upper valve and the lower valve, the flow-through gasket comprising at least one aperture and comprising an elastomeric material, the flow-through gasket further comprising:

a substantially disk-shaped body with a top raised center section and a bottom raised center section;

the at least one aperture being located on the substantially disk-shaped body and being alignable with the at least one aperture of the lower valve and with the at least one aperture of the upper valve to define a delivery passageway for the product;

a first circular ring surrounding the at least one aperture on a bottom side of the substantially disk-shaped body;

a second circular ring surrounding the at least one aperture on a top side of the substantially disk-shaped body; and an outer perimeter comprises a plurality of flat sides and a plurality of semicircular sides, alternating on the substantially disk-shaped body.

12. The dispenser of claim 11, wherein the raised position defines a use position as an open state to deliver product and the retracted position defines a non-use position as a closed state to store the dispenser.

13. The dispenser of claim 11, wherein the shaped path comprises at least one of a substantially J-shape configuration, a substantially L-shape configuration, a substantially T-shape configuration, a substantially forked-shape configuration, or a substantially Y-shape configuration.

14. The dispenser of claim 11, furthering comprising a guide pin coupled to the upper valve, the guide pin being selectively movable in the shaped path of the sleeve.

15. The dispenser of claim 11, wherein the movement of the lower valve and the upper valve in the guidable position of the shaped path comprises at least one of rotating the sleeve or moving a guide pin.

16. The dispenser of claim 11, further comprising a guide pin located on the upper valve, wherein a user selectively moves the guide pin along the shaped path which selectively moves the upper valve and the lower valve, the guide pin being selectively guidable between:

i) a first position along the shaped path for the dispenser to be in an open state to with the applicator raised to deliver the product, and ii) a second position along the shaped path for the dispenser to be in a closed state with the applicator retracted.

* * * * *